US006179146B1

(12) United States Patent
Betras

(10) Patent No.: US 6,179,146 B1
(45) Date of Patent: Jan. 30, 2001

(54) DOUBLE CHAMBERED CONTAINER

(75) Inventor: Joe Betras, Spartanburg, SC (US)

(73) Assignee: Betras Plastics, Inc., Spartanburg, SC (US)

( * ) Notice: Under 35 U.S.C. 154(b), the term of this patent shall be extended for 0 days.

(21) Appl. No.: 09/461,956

(22) Filed: Dec. 15, 1999

(51) Int. Cl.[7] ..... B65D 1/04

(52) U.S. Cl. ..... 220/23.4; 220/23.86; 220/709; 215/229; 215/6; 215/388

(58) Field of Search ..... 215/6, 10, 388, 215/229; 220/23.4, 23.9, 23.86, 23.83, 709, 705; 222/129

(56) References Cited

U.S. PATENT DOCUMENTS 1,954,369 * 4/1934 Solomon .
2,661,870 * 12/1953 Huenergardt .
3,045,925 * 7/1962 Gianguazano .
3,391,830 * 7/1968 Kitchens .
3,851,800 * 12/1974 Swain ..... 222/145.1
4,886,176 * 12/1989 Steakley ..... 215/229
5,180,079 * 1/1993 Jeng .
5,356,040 * 10/1994 Reggiani ..... 222/129
5,735,422 * 4/1998 Binter ..... 220/4.21
5,954,213 * 9/1999 Gerhart et al. ..... 215/10
6,010,034 * 1/2000 Walthers .

OTHER PUBLICATIONS

Twin–Cup, Sewon International, Inc.

* cited by examiner

*Primary Examiner*—Stephen Castellano
(74) *Attorney, Agent, or Firm*—Dority & Manning, P.A.

(57) ABSTRACT

The present invention is generally directed to a container having first and second hollow chambers attached to a top. The first chamber has a helical surface that can be placed adjacent to a corresponding helical surface of the second chamber. The top can include a pair of apertures for receiving a straw such that one aperture resides above each chamber. A straw can be placed into one of the apertures when one desires to drink from the container. The drinking container can further include an attachment device for better attaching the helical chambers.

15 Claims, 5 Drawing Sheets

DOUBLE CHAMBERED CONTAINER

FIELD OF THE INVENTION

The present invention is generally directed to a container or bottle. More particularly, the present invention is directed to a double chambered container that is capable of containing two separate liquids. In one embodiment, the chambers of the container are helical in shape and are connected by a top and an attachment device.

BACKGROUND OF THE INVENTION

In the past, all types of vessels having various shapes and functions have been proposed and used for holding liquids. One particular type of vessel, such as a drinking bottle, that is of current interest is a container or bottle that can contain more than one type of liquid. In addition to the useful benefit of containing more than one liquid, a double chambered container can also be of aesthetic interest. For example, a double chambered container can often spark the curiosity of consumers due to its unique appearance, particularly when each chamber houses a differently colored liquid or is, at least, made from differently colored halves.

A double chambered container can have various applications. For example, a double chambered bottle can be used to carry two different types of drinks. One example of such a bottle is the TWIN CUP® made by Sewon Industries, Inc. The TWIN CUP® is a double chambered drinking container that can hold more than one drink. Its two chambers are identical and line up along a flat edge on each half of a cylinder Using a straw, a consumer can use this container to drink one type of liquid for a period of time before switching to another. However, because the chambers contain edges that are parallel to each other, the chambers of the TWIN CUP® are not always sufficiently integrated so as to impart a completely stable product. In addition, consumers and advertisers often desire bottles with a more appealing aesthetic shape.

Thus, despite the benefits of such known containers, a need nevertheless exists for improved double-chambered containers. In particular, a need exists for a double-chambered container having chambers that can be better integrated to form a more stable bottle. Moreover, a need also exists for a double-chambered container having enhanced aesthetic qualities.

SUMMARY OF THE INVENTION

Accordingly, an object of the present invention is to provide a container having two chambers capable of receiving two different liquids.

It is another object of the present invention to provide a double-chambered container having enhanced aesthetic qualities.

Still another object of the present invention is to provide two chambers that can be attached in a manner such that the resulting container is sufficiently integrated.

Yet another object of the present invention is to provide a double-chambered container that includes chambers having helical surfaces.

It is another object of the present invention to provide a double-chambered container that can be connected by a top.

Another object of the present invention is to provide a double-chambered container having a top that includes one aperture over each chamber for receiving a straw.

Still another object of the present invention is to provide a double-chambered container that is further connected by an attachment device.

These and other objects of the present invention are achieved by providing a container having two chambers with helical surfaces. To form the container, the helical surfaces of each chamber can be placed adjacent to one another. As a result of such placement, threads located along the top portion of each chamber can become aligned. Thereafter, a top containing grooves can be screwed onto the threads of the chambers so that the chambers become connected. In addition to being connected by a top, the helical chambers of the present invention may, in some embodiment, also be connected by an attachment device. For example, in one embodiment, a snap is provided to connect the bottom portion of the chambers. In other embodiments, the connection is provided by a bottom cap.

In addition to attaching the chambers, a top of the present invention can also contain apertures adapted to receive a straw. In one embodiment, a top of the present invention includes apertures that an be positioned over each chamber such that liquid from each chamber can be utilized. As a result of the present invention, a consumer can drink different liquids from one container having two helically-shaped chambers.

Other objects, features and aspects of the present invention are discussed in greater detail below.

BRIEF DESCRIPTION OF THE DRAWINGS

A full and enabling disclosure of the present invention, including the best mode thereof, to one of ordinary skill in the art, is set forth more particularly in the remainder of the specification, including reference to the accompanying figures, in which.

Figure 1:
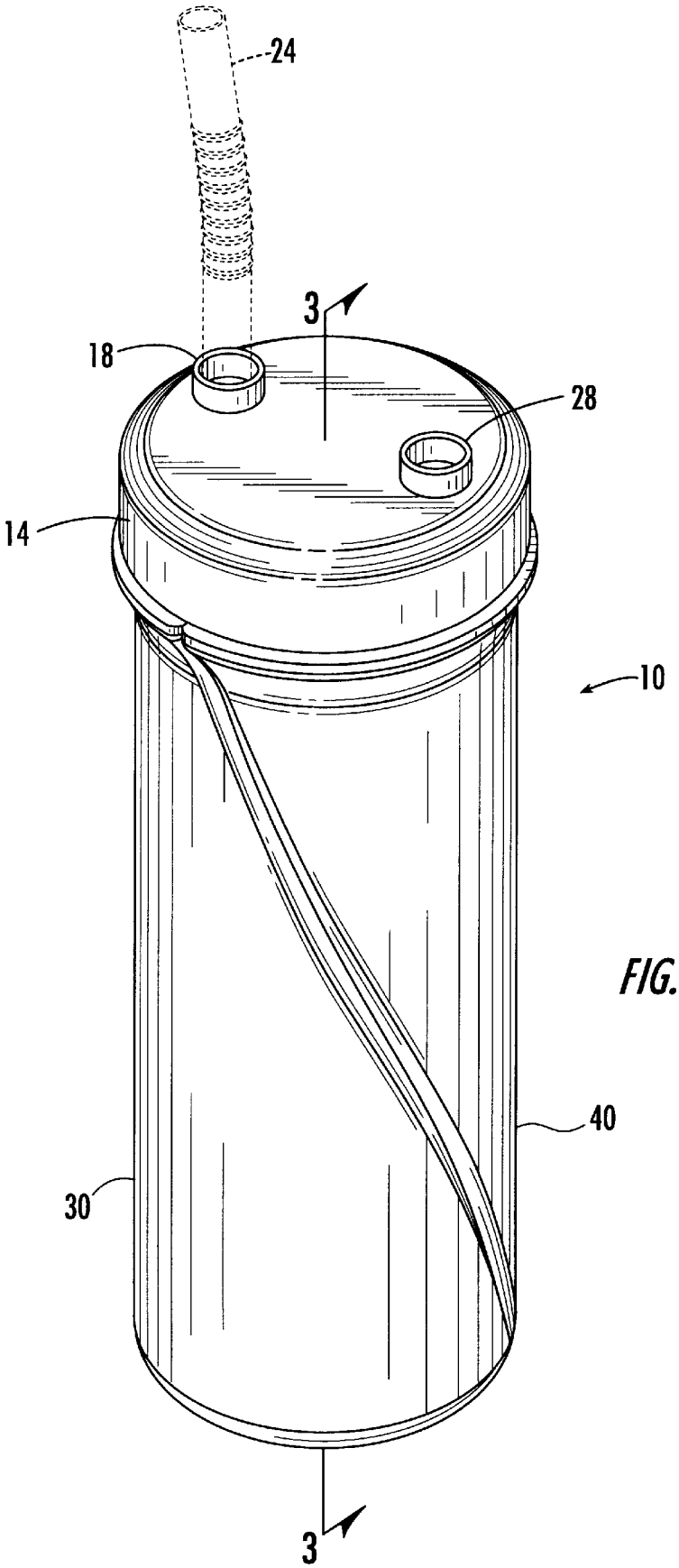
FIG. 1 is a partial perspective exploded view of one embodiment of a double-chambered drinking container of the present invention.

Repeat use of reference characters in the present specification and drawings is intended to represent same or analogous features or elements of the invention.

Detailed Description of Preferred Embodiments Reference now will be made in detail to the embodiments of the invention, one or more examples of which are set forth below. Each example is provided by way of explanation of the invention, not limitation of the invention. In fact, it will be apparent to those skilled in the art that various modifications and variations can be made in the present invention without departing from the scope or spirit of the invention. For instance, features illustrated or described as part of one embodiment, can be used on another embodiment to yield a still further embodiment. Thus, it is intended that the present invention cover such modifications and variations as come within the scope of the appended claims and their equivalents. Other objects, features and aspects of the present invention are disclosed in or are obvious from the following detailed description. It is to be understood by one of ordinary skill in the art that the present discussion is of exemplary embodiments only, and is not intended as limiting the broader aspects of the present invention.

In general, the present invention is directed to a container having a first and second hollow chamber that may be integrated together and bound by a top. The top includes at least one aperture for receiving a straw. In one embodiment, the top includes a first aperture for inserting one end of a straw into a first chamber and a second aperture for inserting one end of another straw into a second chamber. Optionally, the same straw could be utilized for insertion into both chambers. Of particular advantage, each chamber of a container of the present invention is helical in shape so as to provide a more integral bottle structure and enhanced aesthetic qualities. In addition to being attached to a top, the chambers can also be attached, in one embodiment, by an attachment device. In another embodiment, the chamber can be attached by a bottom. Once the chambers of the container are attached by the top, bottom and/or by the attachment device, the chambers can be filled with the same or different liquids. Thus, the container can often provide a user with two choices of liquids, such as drinks.

Figure 3:
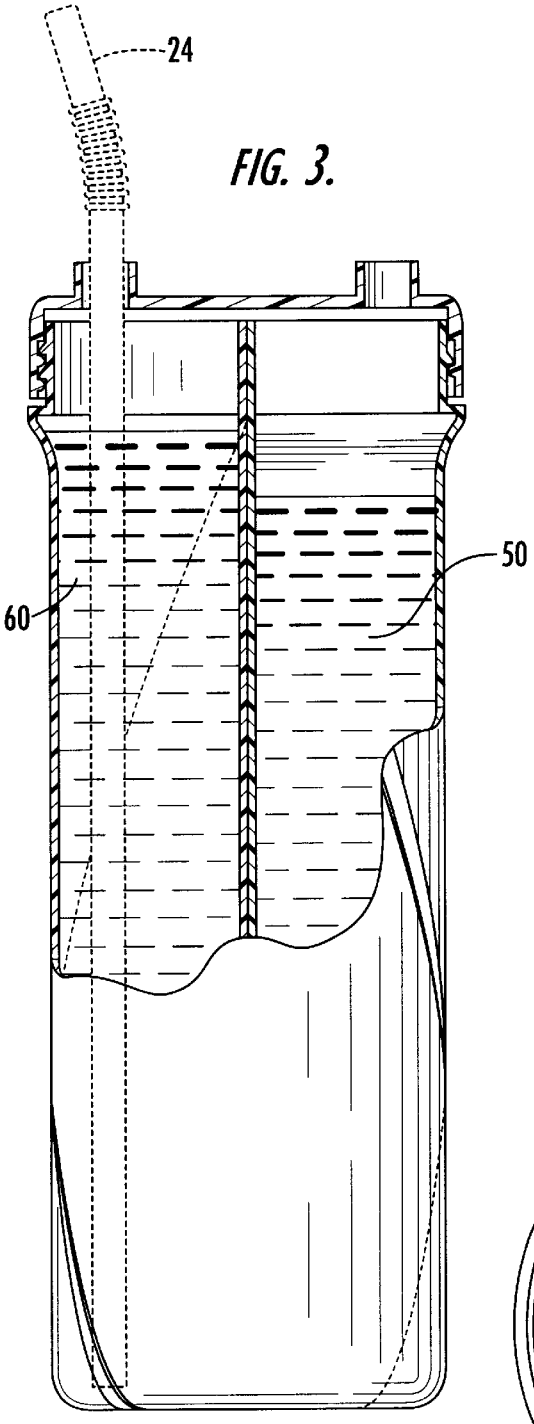
FIG. 3 is a cross-sectional view of the drinking container illustrated in FIG. 1 taken along a line 3—3.
Figure 4:
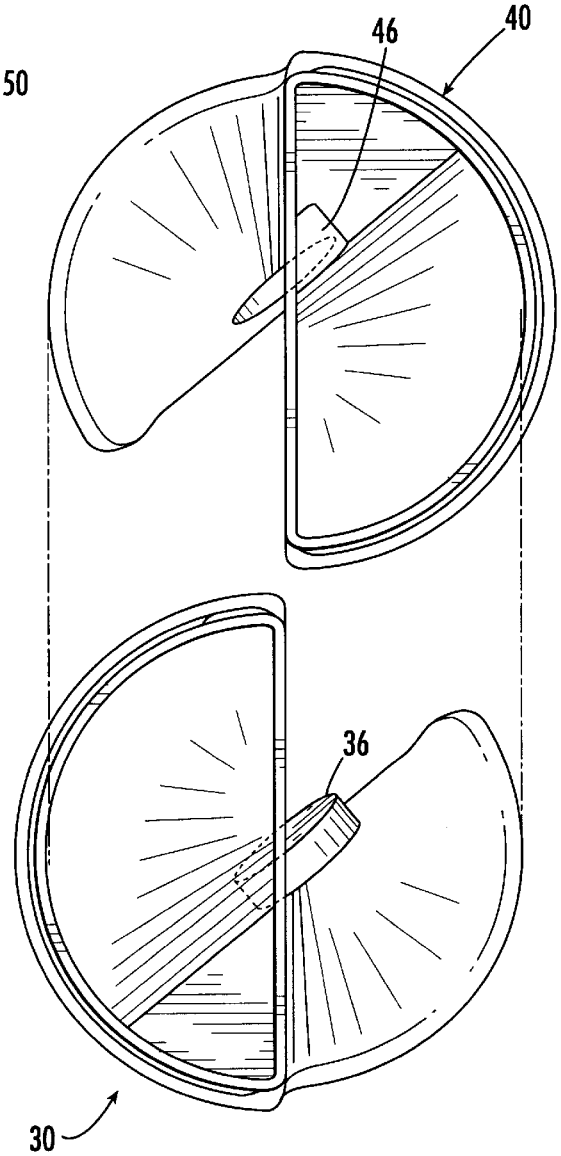
FIG. 4 is a partial overhead cross-sectional view of one embodiment of a double-chambered container of the present invention.
Figure 5:
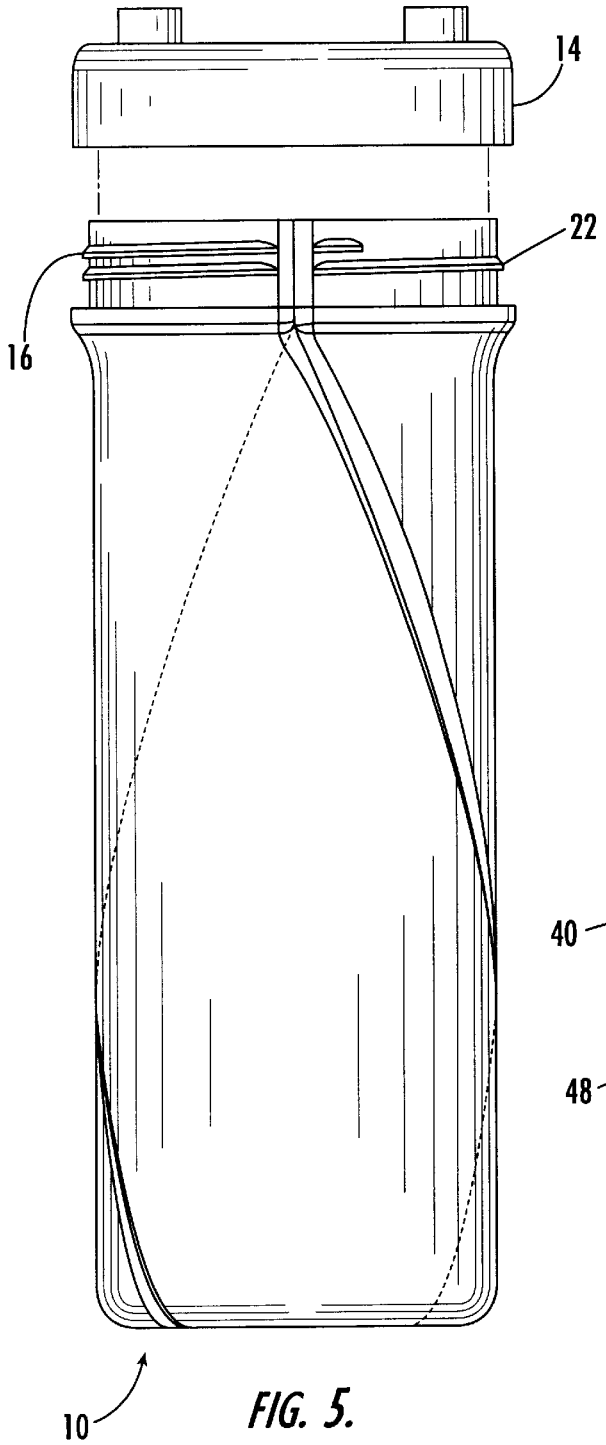
FIG. 5 is a side view of one embodiment a double-chambered container of the present invention shown with a detached top.

For instance, referring to FIGS. 1–6, one embodiment of a drinking container 10 made in accordance with the present invention is illustrated. Drinking container 10 includes a first chamber 30 and a second chamber 40 for containing one or more drinks or refreshments. A top 14 is connected to first chamber 30 and second chamber 40. When the chambers are positioned adjacent to each other, top 14 can be screwed onto first chamber 30 and second chamber 40 using threads 16 and 22 as shown in FIG. 5, for example.

Figure 6:
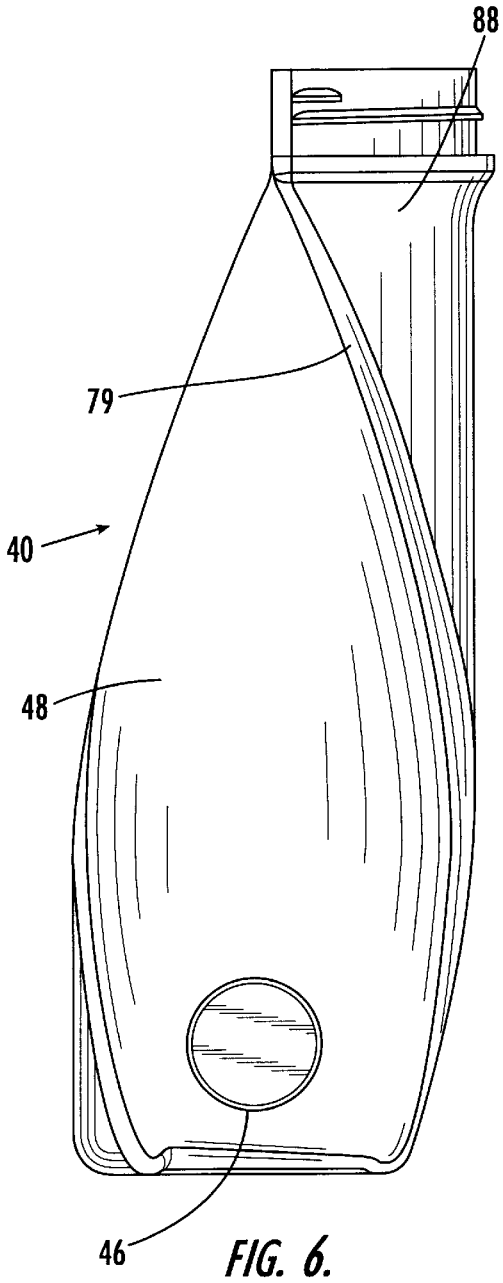
FIG. 6 is a side view of one chamber of a double-chambered container of the present invention.
Figure 7:
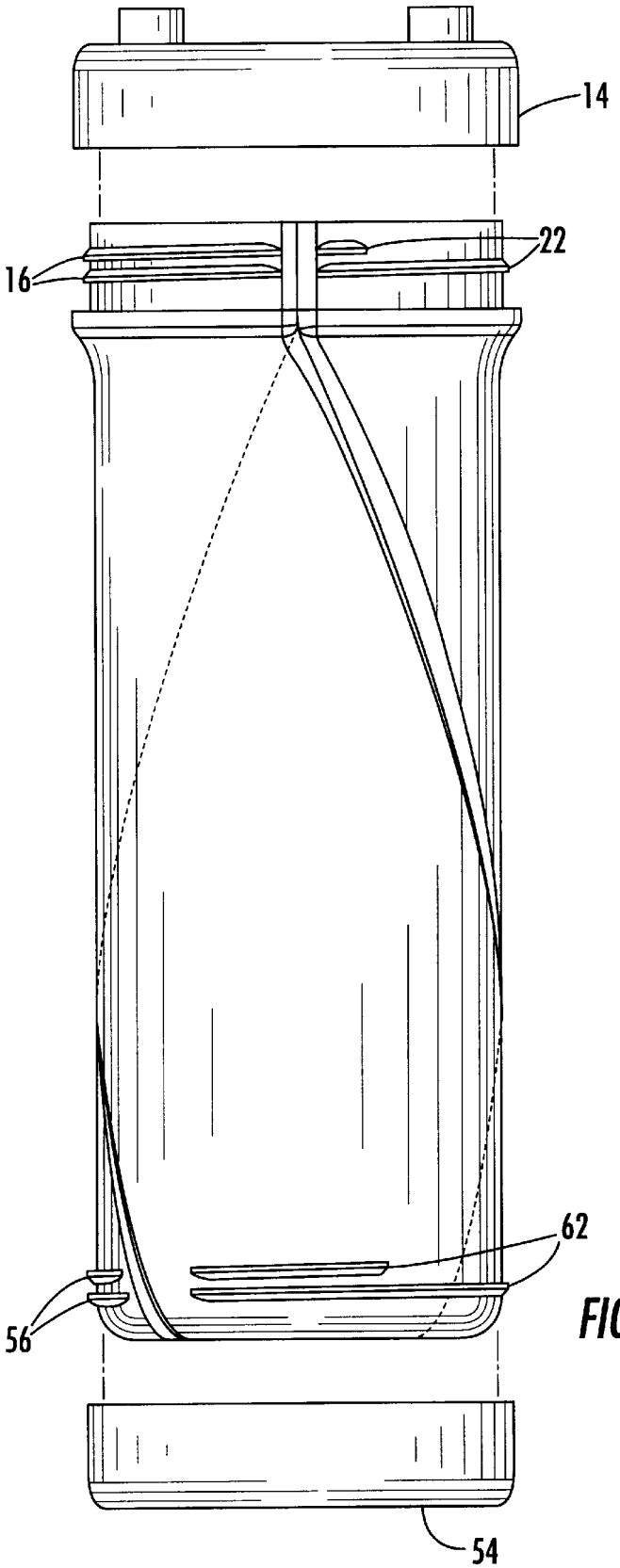
FIG. 7 is a side view of an alternative embodiment of the present invention.

In one embodiment, chambers 30 and 40 can be further attached by an attachment device, such as a snap-fit device 36 shown in FIGS. 4 & 6. Moreover, in another embodiment, chambers 30 and 40 can be attached at the bottom using a device similar to top 14. In particular, as shown in FIG. 7, chambers 30 and 40 can be positioned adjacent to each other and attached by bottom 54. As shown, bottom 54 can be screwed onto first chamber 30 and second chamber 40 using threads 56 and 62, for example. Although the bottom end of chambers 30 and 40 can be open such as the top end depicted in FIG. 2, it is typically desired that the bottom be enclosed.

Figure 2:
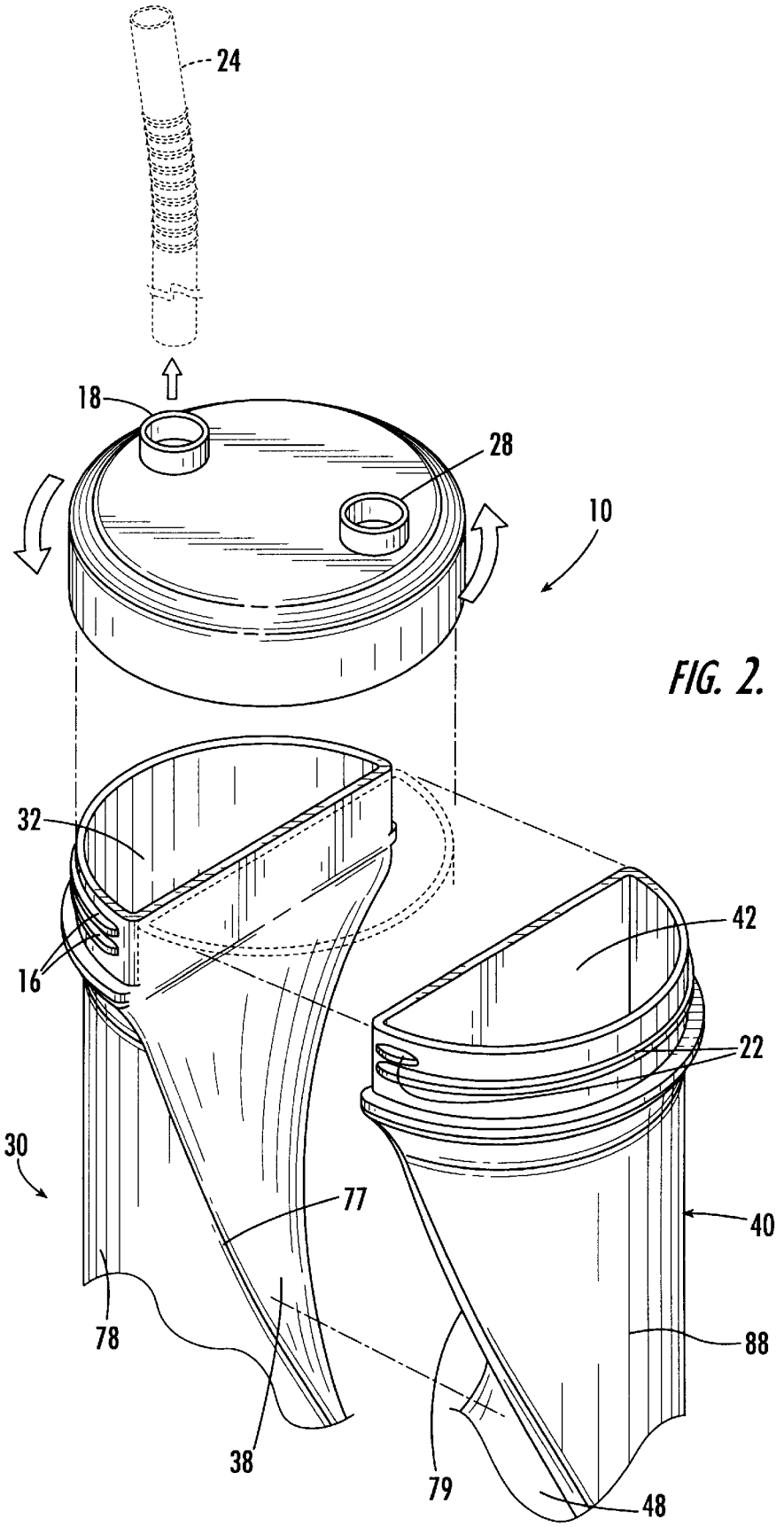
FIG. 2 is a perspective view of the double-chambered container illustrated in FIG. 1 with each chamber shown separately.

As stated, a drinking container 10 of the present invention generally includes a first chamber 30 and a second chamber 40. In one embodiment, each chamber of a double-chambered bottle of the present invention is helical in shape such that the container has enhanced aesthetic qualities. Moreover, such a helical shape can also provide a more integral container. For instance, FIG. 2 illustrates a mechanism by which chambers of the present invention can form a more integral container. As shown, first chamber 30 includes a mating surface 38, while second chamber 40 includes a mating surface 48 corresponding to mating surface 38. Moreover, as shown in FIGS. 2 and 6, the first chamber 30 includes a first outer surface 78 that forms a helical joint 77 with the first mating surface 38, while the second chamber includes a second outer surface 88 that forms a helical joint 79 with the second mating surface 48. When surface 38 is placed into contact with surface 48, a more integral container structure, such as the container 10 depicted in FIG. 1, can be formed.

In order to attach chambers of the present invention, a top is typically provided. For instance, referring to FIGS. 2, 4, and 5, top 14 can be utilized to connect first chamber 30 with second chamber 40. To attach top 14, chambers 30 and 40 are first positioned such that surface 38 is positioned adjacent to surface 48. As a result of such positioning, threads 16 located on chamber 30 become substantially aligned with threads 22 located on chamber 40. Thus, top 14 can be screwed in a clockwise direction onto threads 16 and 22 to connect chambers 30 and 40. As shown by the direction arrows in FIG. 2, top 14 can likewise be removed from container 10 by unscrewing it in a counter-clockwise direction.

Similarly, in the embodiment depicted by FIG. 7, bottom 54 can be attached by first positioning chambers 30 and 40 such that surface 38 is located adjacent to surface 48. As a result, threads 56 located on chamber 30 become substantially aligned with threads 62 located on chamber 40. Thus, bottom 54 can be screwed in a counter-clockwise direction onto threads 56 and 62 to further connect chambers 30 and 40. Likewise, bottom 54 can be removed from container 10 by unscrewing it in a clockwise direction.

In addition to top 14 and/or bottom 54, an attachment device can also be provided to further attach the chambers of a double chambered container of the present invention. One embodiment of an attachment device is depicted in FIGS. 4 and 6. As shown in FIG. 4, a snap-fit device 36 is attached to first chamber 30. When chamber 30 is placed adjacent to chamber 40, snap-fit device 36 can be inserted into an aperture 46 that corresponds to snap-fit device 36. As a result of the insertion of snap-fit device 36 into aperture 46, a container of the present invention can become better attached. Moreover, as depicted in FIG. 6, one embodiment of the present invention has an attachment device including an aperture 46 at the bottom of second chamber 40 to connect to a snap-fit device 36 (not shown) on said first chamber 30 (not shown) such that the bottom of container 10 can be connected in a more secure manner. Thus, although not required, an attachment device of the present invention can often provide a better connection between chambers. In addition, various types and forms of attachment devices could also be utilized. Examples would include hook and loop mechanisms, clipping mechanisms, fabric attachment devices such as VELCRO, magnetic device, etc.

The ability of a double-chambered container of the present invention to be used for drinking two separate drinks will now be described in more detail. Referring to FIGS. 2, 3, & 6 a double-chambered container 10 as described above is depicted. If chambers 30 and 40 are open their bottom end, it is generally necessary that bottom 54 first be screwed onto threads 56 and 62 before pouring a drink into container 10. However, when the bottom ends of chambers 30 and 40 are not open, a first drink 60, such as shown in FIG. 3, can be added to first chamber 30 by pouring it into hollow chamber 32 (FIG. 2) without the use of bottom 54. Thereafter, a second drink 50 (optionally of a different color than drink 60) can be added to second chamber 40 by pouring it into hollow chamber 42 (FIG. 2). Although consumable drinks are discussed in detail herein, it should be understood that other liquids and fluids can be utilized in accordance with the present invention. For example, two jellies, salad dressings, shampoo/conditioner, cosmetics, etc., can be added to chambers of the present invention. In fact, any combination of liquids or fluids can be added.

After adding the desired liquids or drinks, a user can then screw top 14 onto the container as described above. Referring to FIGS. 1–3, one embodiment of top 14 includes a pair of raised side apertures 18 and 28 that are each adapted to receive an end of a straw. For example, as shown, straw 24 can be inserted into aperture 18 such that it is capable of withdrawing fluid from first chamber 30. It should also be understood that, although not shown, a similar straw 24 can also be inserted into aperture 28 such that fluid can also be withdrawn from second chamber 40. Optionally, only one straw could be used to drink from both chambers. Generally, aperture 18 of top 14 is designed to allow the drinking end of straw 24 to be inserted into drinking container 10 and removed when desired. On the other hand, a straw 24 can likewise be removable from aperture 28.

Thus, by placing a straw into aperture 18, a user can consume a drink 60 from chamber 30. Moreover, by placing a straw into aperture 28, a user can consume a drink 50 from chamber 40. Straws can be placed into the apertures of the container top either simultaneously or at different times, depending on the preference of the consumer. Therefore, the double chambered container of the present invention can provide the user a choice of two drinks, as desired. In addition, as a result of various features, a double-chambered container of the present invention can provide improved double-chamber integration and enhanced aesthetic qualities.

Moreover, in one embodiment, chambers 30 and 40 can also be attached at their bottom ends, either before or after pouring drinks 50 or 60 into the chambers. In particular, as discussed above, the bottom ends can be attached through the use of an attachment device 36 or a bottom 54 that can be screwed onto threads 56 and 62. In other embodiments, multiple attachment devices can be utilized.

In general, a container 10 of the present invention can be made from various materials, including glass or plastics. In one particular embodiment, container 10 is constructed by blow molding a plastic material. If desired, the container can be adapted to receive an emblem or to be screenprinted with a particular design. Moreover, in most applications, container 10 will be adapted to contain from about 10 ounces to about 32 ounces of a liquid.

Although various embodiments of the invention have been described using specific terms, devices, and methods, such description is for illustrative purposes only. The words used are words of description rather than limitation. It is to be understood that changes and variations may be made by those of ordinary skill in the art without departing from the spirit or the scope of the present invention, which is set forth in the following claims. In addition, it should be understood that aspects of the various embodiments may be interchanged both in whole or in part. Therefore, the spirit and scope of the appended claims should not be limited to the description of the preferred versions contained therein.

What is claimed is:

1. A container comprising:

a first chamber adapted to receive a liquid therein, said first chamber having a first outer surface and a first mating surface, said first outer surface and said first mating surface forming a helical joint therebetween;

a second chamber adapted to receive a liquid therein, said second chamber having a second outer surface and a second mating surface;

wherein said first chamber and said second chamber form a container body when said first mating surface is placed adjacent to said second mating surface, said container body having a top portion and a bottom portion; and a top removably secured to said top portion of said container body, said top defining a first aperture above said first chamber adapted to receive a straw, said top also defining a second aperture above said second chamber adapted to receive a straw.

2. A container as defined in claim 1, further comprising an attachment device for securing said first chamber to said second chamber at said bottom portion of said container body.

3. A container as defined in claim 2, wherein said attachment device comprises a snap-fit device.

4. A container as defined in claim 1, wherein said first and said second chambers are made from a plastic material.

5. A container as defined in claim 1, wherein a first drink is contained within said first chamber and a second drink is contained within said second chamber.

6. A container as defined in claim 2, wherein said attachment device comprises a bottom removably secured to said bottom portion of said container body.

7. A container as defined in claim 6, wherein said bottom comprises a cap having threads for engaging said container body bottom portion.

8. A container comprising:

a first chamber adapted to receive a liquid therein, said first chamber having a first outer surface and a first mating surface, said first outer surface and said first mating surface forming a first helical joint therebetween;

a second chamber adapted to receive a liquid therein, said second chamber having a second outer surface and a second mating surface forming a second helical joint therebetween corresponding to said first helical joint of said first chamber; and wherein said first chamber and said second chamber form a container body when said first mating surface is placed adjacent to said second mating surface, said container body having a top portion and a bottom portion.

9. A container as defined in claim 8, further comprising a top removably secured to said top portion of said container body, said top defining a first aperture above said first chamber adapted to receive a straw, said top also defining a second aperture above said second chamber adapted to receive a straw.

10. A container as defined in claim 8, further comprising an attachment device for securing said first chamber to said second chamber at said bottom portion of said container body.

11. A container as defined in claim 8, further comprising a bottom removably secured to said bottom portion of said container body.

12. A container as defined in claim 11, wherein said bottom comprises a cap having threads for engaging said container body bottom portion.

13. A container comprising:

a first chamber adapted to receive a liquid therein, said first chamber having a first outer surface and a first mating surface, said first outer surface and said first mating surface forming a first helical joint therebetween;

a second chamber adapted to receive a liquid therein, said second chamber having a second outer surface and a second mating surface forming a second helical joint therebetween corresponding to said first helical joint of said first chamber;

wherein said first chamber and said second chamber form a container body when said first mating surface is placed adjacent to said second mating surface, said container body having a top portion and a bottom portion;

a top removably secured to said top portion of said container body, said top defining a first aperture above said first chamber adapted to receive a straw, said top also defining a second aperture above said second chamber adapted to receive a straw; and a bottom removably secured to said bottom portion of said container body.

14. A container as defined in claim 13, further comprising an attachment device for securing said first chamber to said second chamber at said bottom portion of said container body.

15. A container as defined in claim 13, wherein said bottom comprises a cap having threads for engaging said container body bottom portion.

* * * * *